US005964500A

United States Patent [19]

Lin

[11] Patent Number: 5,964,500

[45] Date of Patent: Oct. 12, 1999

[54] SECURITY DEVICE FOR FOLDABLE CHAIR

[76] Inventor: Steve Lin, No. 80, Kengtsai, Chiayi Hsien, Taiwan

[21] Appl. No.: 09/228,945

[22] Filed: Jan. 12, 1999

[51] Int. Cl.[6] ..... A47C 4/00

[52] U.S. Cl. ..... 297/16.1; 297/31; 297/39

[58] Field of Search ..... 297/16.1, 31, 35, 297/39, 40, 378.12, 463.1

[56] References Cited

U.S. PATENT DOCUMENTS

| | | | |
|---|---|---|---|
| 3,319,997 | 5/1967 | Clement | 297/16.1 |
| 4,772,068 | 9/1988 | Gleckler et al. | 297/39 |
| 5,054,848 | 10/1991 | Liu | 297/16.1 |
| 5,529,270 | 6/1996 | Liu | 297/31 |
| 5,707,105 | 1/1998 | Liu | 297/16.1 |
| 5,735,570 | 4/1998 | Tseng | 297/35 |
| 5,899,525 | 5/1999 | Tseng | 297/16.1 |

FOREIGN PATENT DOCUMENTS

| | | | |
|---|---|---|---|
| 718700 | 9/1965 | Canada | 297/31 |
| 120432 | 10/1984 | European Pat. Off. | 297/16.1 |
| 170409 | 4/1986 | European Pat. Off. | 297/16.1 |
| 872971 | 3/1960 | United Kingdom | 297/31 |

*Primary Examiner*—Laurie K. Cranmer
*Attorney, Agent, or Firm*—Bacon & Thomas

[57] ABSTRACT

A foldable chair includes a U-shaped seat support frame including two seat support rods, a U-shaped front support frame including two front legs each pivotally mounted to the respective seat support rod, a U-shaped rear support frame including two rear legs each pivotally mounted to the respective seat support rod, an inverted U-shaped backrest support frame including two backrest support rods each pivotally mounted to the respective rear leg, two armrests each pivotally mounted between the front leg and the backrest support rod, and two linking rods each pivotally mounted between the front leg and the backrest support rod. A security device includes two locking strips each slidably mounted between the backrest support rod and the seat support rod, and each having an upper end portion containing an L-shaped passage having a slide slot and a stop recess, a mediate portion containing a limit slot, and a lower end portion containing a locking opening, two slide pins each extending through the slide slot, the linking rod, and through the backrest support rod, two limit pins each extending through the limit slot, the backrest support rod, and through the rear leg, and two locking pins each having one end portion secured in the seat support rod, and each detachably received in the locking opening.

6 Claims, 7 Drawing Sheets

SECURITY DEVICE FOR FOLDABLE CHAIR

BACKGROUND OF THE INVENTION

1. Field of the Invention

The present invention relates to a security device, and more particularly to a security device for a foldable chair.

2. Description of the Related Art

The closest prior art of which the applicant is aware is disclosed in U.S. Pat. No. 5,707,105 to Liu, filed on Dec. 4, 1996, entitled "Safety Lock For A Folding Chair". In this patent, the hook (11) can be pivoted relative to the locating pin (41) so as to detach the locating pin (41) from the retaining notch (112) of the hook (11) such that the folding chair can be folded. However, the hook (11) is easily returned to its original position due to the action of gravity to lock the locating pin (41) again, thereby causing inconvenience to a user during the folding process. The present invention has arisen to mitigate and/or obviate the disadvantage of the conventional safety lock for a folding chair.

BRIEF SUMMARY OF THE INVENTION

In accordance with one aspect of the present invention, there is provided a security device for a foldable chair. The foldable chair comprises a substantially U-shaped seat support frame including two seat support rods each having a first end portion and a second end portion, a substantially U-shaped front support frame including two front legs each having an upper end portion, a lower end portion, and a mediate portion pivotally mounted to the first end portion of one of the two corresponding seat support rods, a substantially U-shaped rear support frame including two rear legs each having a lower end portion, a mediate portion, and an upper end portion pivotally mounted to the second end portion of one of the two corresponding seat support rods, and including an extension extending upward in an inclined manner, a substantially inverted U-shaped backrest support frame including two backrest support rods each having an upper end portion, a mediate portion, and a lower end portion pivotally mounted to the extension of the upper end portion of one of the two corresponding rear legs, two armrests each having a first end portion pivotally mounted to the upper end portion of one of the two corresponding front legs, and a second end portion pivotally mounted to the mediate portion of one of the two corresponding backrest support rods, and two linking rods each including a first end portion pivotally mounted to the mediate portion of one of the two corresponding front legs, and a second end portion pivotally mounted to one of the two corresponding backrest support rods located between the mediate portion and the lower end portion.

The security device comprises two elongated locking strips each adapted to be slidably mounted between one of the two corresponding backrest support rods and one of the two corresponding seat support rods, and each including an upper end portion containing a substantially L-shaped passage therein having a longitudinal slide slot and a transverse stop recess connecting with each other, a mediate portion containing an elongated limit slot therein, and a lower end portion containing a locking opening therein; two slide pins each slidably extending through the slide slot of one of the two corresponding locking strips, and each adapted to extend through the second end portion of one of the two linking rods, and through the lower end portion of one of the two corresponding backrest support rods; two limit pins each extending through the limit slot of one of the two corresponding locking strips, and each adapted to extend through the lower end portion of one of the two corresponding backrest support rods, and through the extension of the upper end portion of one of the two corresponding rear legs; and two locking pins each having one end portion secured in the second end portion of one of the two seat support rods, and each detachably received in the locking opening of one of the two corresponding locking strips.

Further benefits and advantages of the present invention will become apparent after a careful reading of the detailed description with appropriate reference to the accompanying drawings.

DETAILED DESCRIPTION OF THE INVENTION

Figure 1:
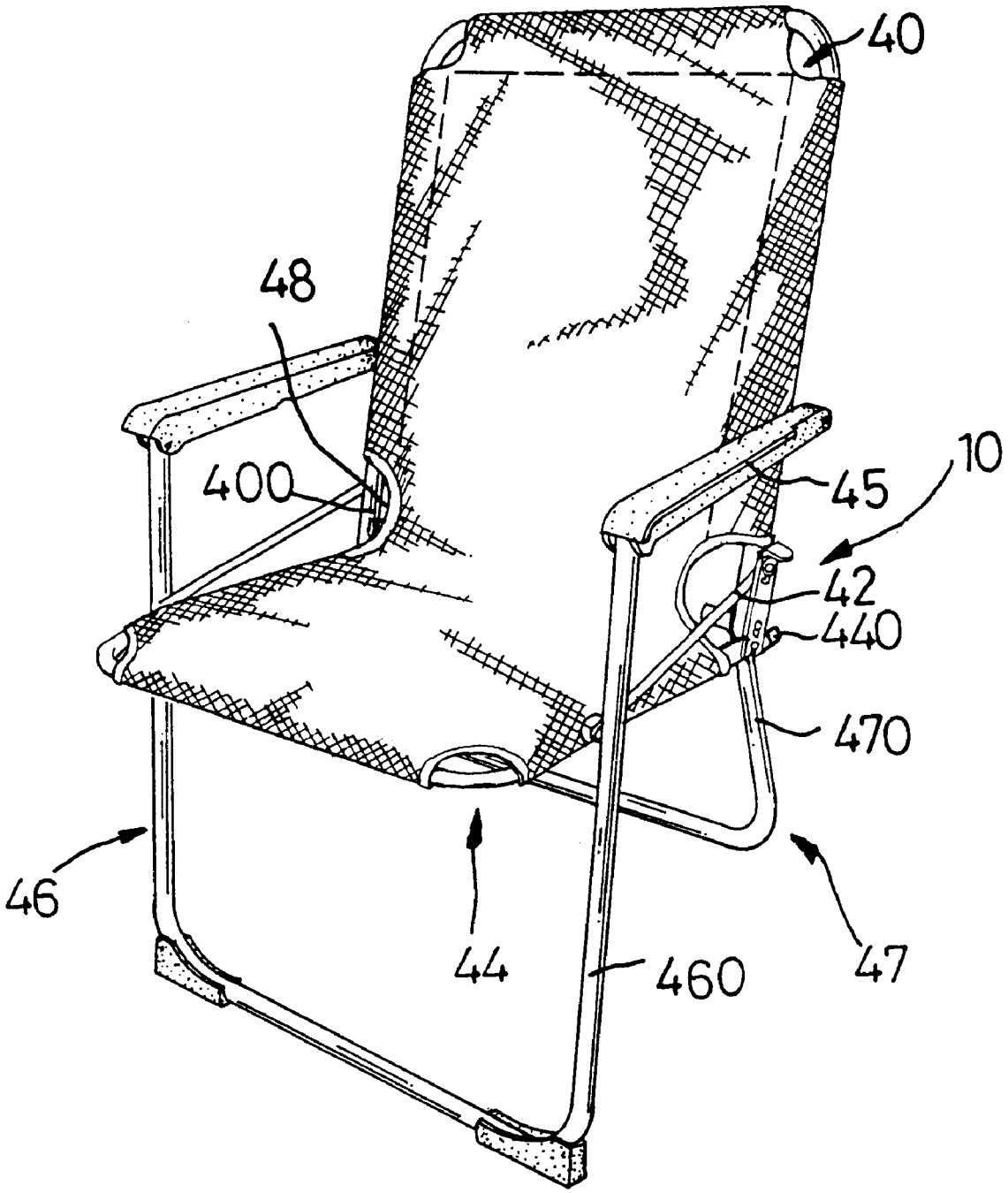
FIG. 1 is a perspective view of a foldable chair in accordance with the present invention.

Referring to the drawings and initially to FIGS. 1–4, a security device in accordance with the present invention can be adapted to be fit on a foldable chair to control the folding and expanding operations of the foldable chair.

The foldable chair comprises a substantially U-shaped seat support frame (44) including two seat support rods (440) each having a first end portion and a second end portion, a substantially U-shaped front support frame (46) including two front legs (460) each having an upper end portion, a lower end portion, and a mediate portion pivotally mounted to the first end portion of one of the two corresponding seat support rods (440), a substantially U-shaped rear support frame (47) including two rear legs (470) each having a lower end portion, a mediate portion, and an upper end portion pivotally mounted to the second end portion of one of the two corresponding seat support rods (440), and including an extension (472) extending upward in an inclined manner, a substantially inverted U-shaped backrest support frame (40) including two backrest support rods (400) each having an upper end portion, a mediate portion, and a lower end portion pivotally mounted to the extension (472) of the upper end portion of one of the two corresponding rear legs (470), a fabric enclosure (48) encompassing the seat support frame (44) and the backrest support frame (40), two armrests (45) each having a first end portion pivotally mounted to the upper end portion of one of the two corresponding front legs (460), and a second end portion pivotally mounted to the mediate portion of one of the two corresponding backrest support rods (400), and two linking rods (42) each including a first end portion pivotally mounted to the mediate portion of one of the two corresponding front legs (460), and a second end portion pivotally mounted to one of the two corresponding backrest support rods (400) located between the mediate portion and the lower end portion.

The security device comprises two elongated locking strips (10) each slidably mounted between one of the two corresponding backrest support rods (400) and one of the two corresponding seat support rods (440), and each including an upper end portion containing therein a substantially L-shaped passage having a longitudinal slide slot (12) and a transverse stop recess (121) connecting with each other, a mediate portion containing an elongated limit slot (14) therein, and a lower end portion containing a locking opening (15) therein, two slide pins (22) each in turn slidably extending through the slide slot (12) of one of the two corresponding locking strips (10), through the second end portion of one of the two linking rods (42), and through the lower end portion of one of the two corresponding backrest support rods (400), and two limit pins (21) each in turn extending through the limit slot (14) of one of the two corresponding locking strips (10), through the lower end portion of one of the two corresponding backrest support rods (400), and through the extension (472) of the upper end portion of one of the two corresponding rear legs (470), and two locking pins (20) each having one end portion secured in the second end portion of one of the two seat support rods (440), and each detachably received in the locking opening (15) of one of the two corresponding locking strips (10).

Each of the two locking strips (10) further includes an extension piece (11) transversely extending from the upper end portion thereof.

The security device further comprises two washers (221) each mounted between one of the two corresponding locking strips (10) and one of the two corresponding slide pins (22).

Each of the two linking rods (42) contains a hole (422) defined in the second end portion thereof for pivotally receiving the slide pin (22) therein, and each of the two backrest support rods (400) contains a bore (402) defined in the lower end portion thereof for pivotally receiving the slide pin (22) therein. Each of the two backrest support rods (400) contains a bore (404) defined in the lower end portion thereof for pivotally receiving the limit pin (21) therein, and each of the two rear legs (470) contains a hole (474) defined in the extension (472) of the upper end portion thereof for pivotally receiving the limit pin (21) therein. Each of the two seat support rods (440) contains a bore (442) defined in the second end portion thereof for securely receiving the locking pin (20) therein.

Figure 2:
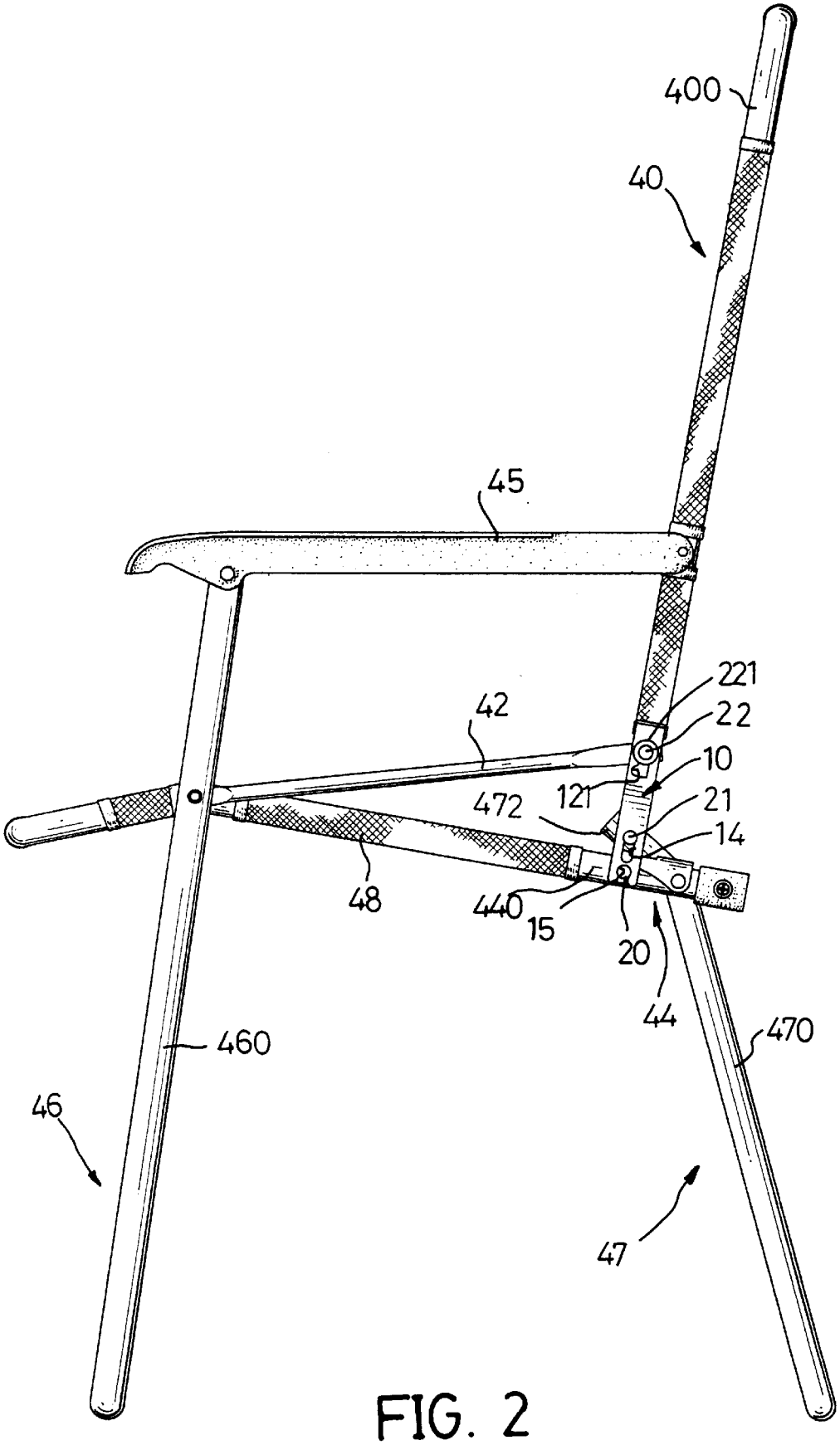
FIG. 2 is a side plan view of the foldable chair as shown in FIG. 1.
Figure 3:
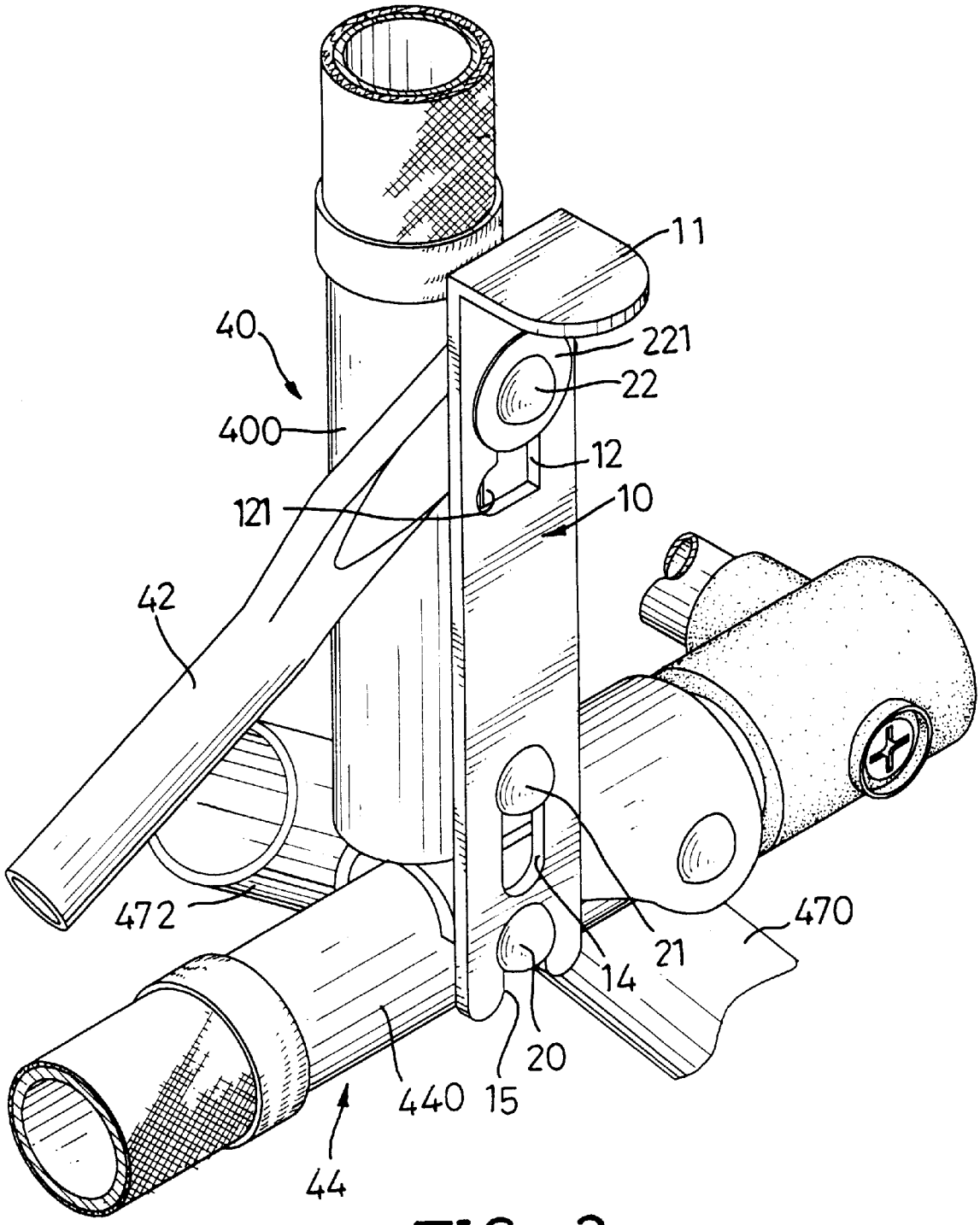
FIG. 3 is a perspective view of a security device for the foldable chair in accordance with the present invention.
Figure 4:
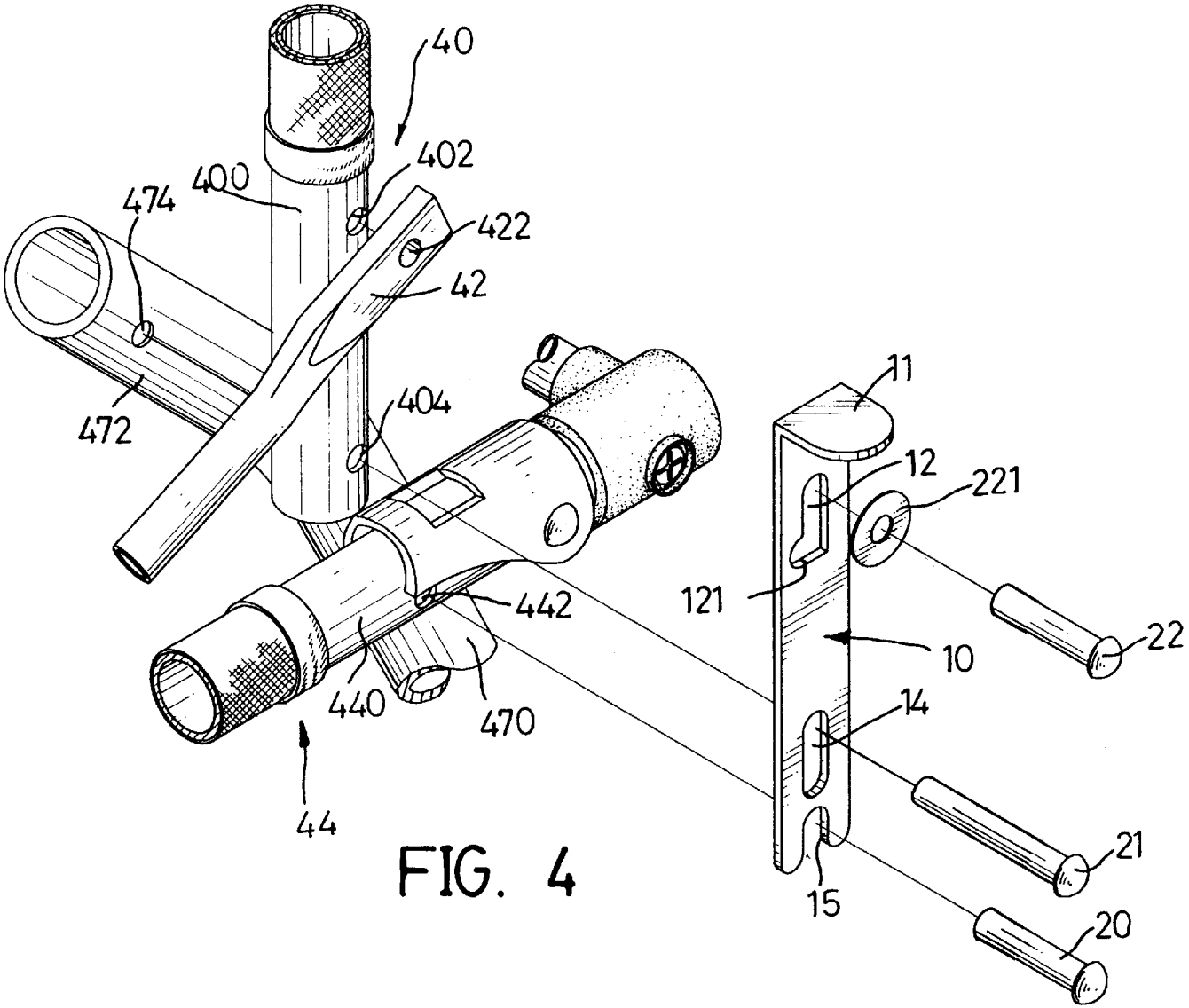
FIG. 4 is an exploded perspective view of the security device as shown in FIG. 3.
Figure 5:
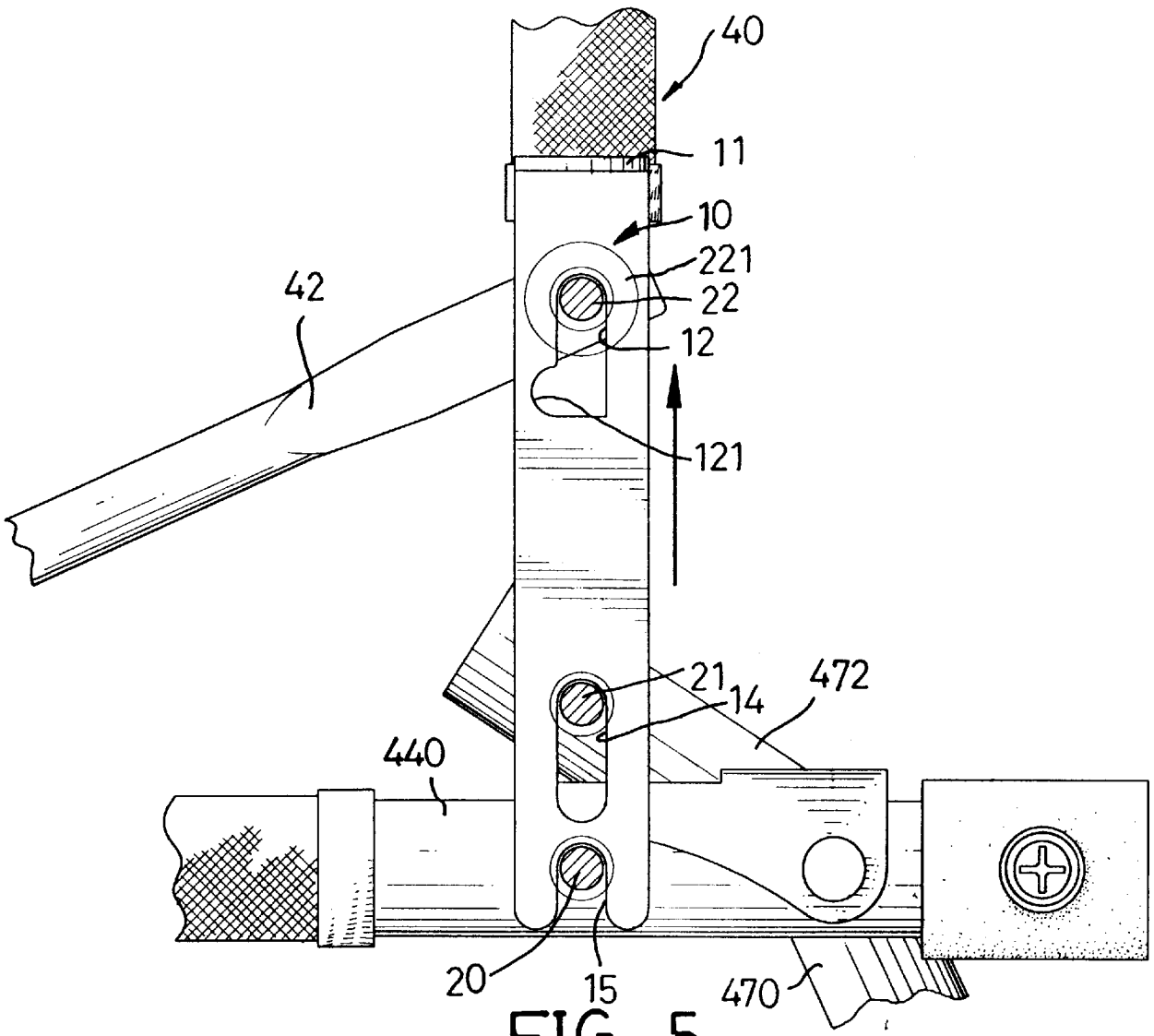
FIG. 5 is a front plan cross-sectional view of the security device as shown in FIG. 3.
Figure 6:
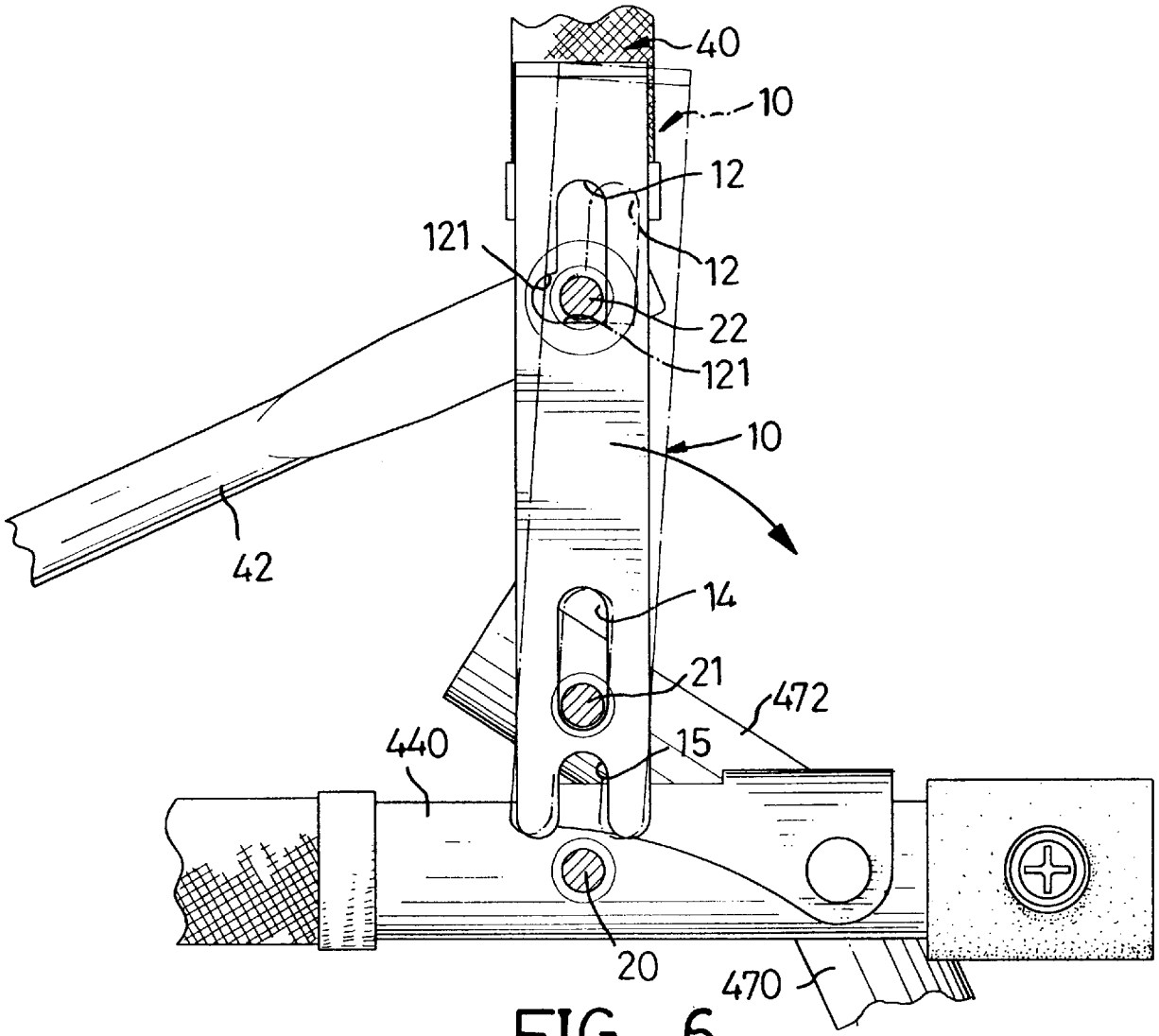
FIG. 6 is an operational view of the security device as shown in FIG. 5.
Figure 7:
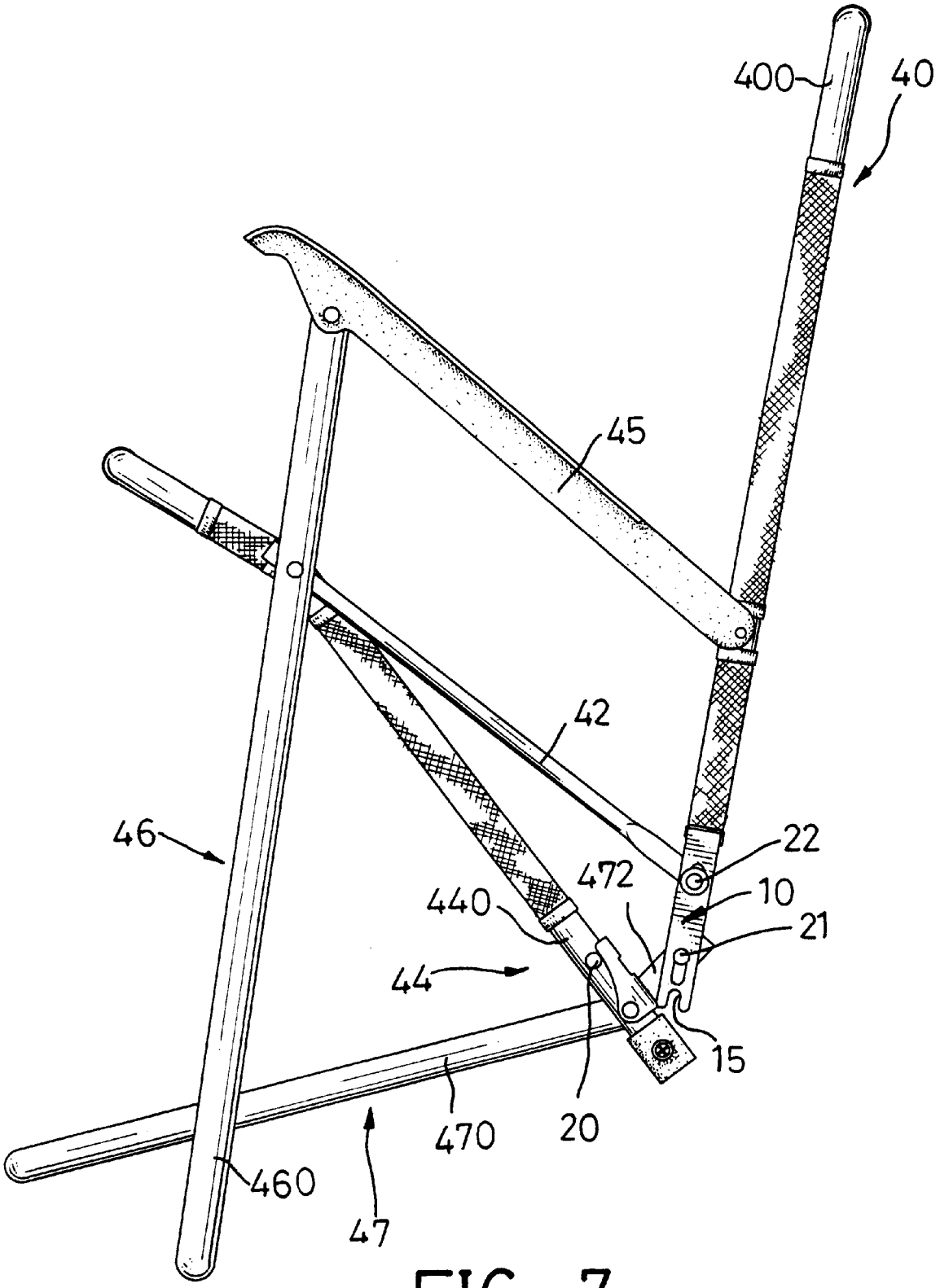
FIG. 7 is an operational view of the foldable chair as shown in FIG. 2, showing the foldable chair being folded.

In operation, referring to FIGS. 5–7 with reference to FIGS. 1–4, the foldable chair is initially expanded as shown in FIG. 2 with the slide pin (22) in the top of the slide slot (12) and the locking pin (20) in the locking opening (15) as shown in FIG. 5, thereby securing each of the two backrest support rods (400) to the respective seat support rod (440) by means of the respective locking strip (10) such that the foldable chair is rigidly and stably supported.

Each of the two locking strips (10) is then moved upward by exerting an upward force on the extension piece (11) from the position as shown in FIG. 5 to the position as shown in FIG. 6, with the slide pin (22) in the bottom of the slide slot (12) and the locking pin (20) being detached from the locking opening (15), thereby detaching the engagement between each of the two locking strips (10) and the respective locking pin (20) such that each of the two backrest support rods (400) and the respective seat support rod (440) can be freely pivoted relative to each other.

Each of the two locking strips (10) is then pivoted relative to the respective limit pin (21) in the direction as shown in the arrow in FIG. 6 such that the slide pin (22) is received into the stop recess (121) as shown in phantom lines in FIG. 6, thereby securing the locking strip (10) to the slide pin (22) so as to hold the locking strip (10), such that the locking strip (10) will not drop down due to the force of gravity to relock the locking pin (20), thereby allowing a user to fold the foldable chair.

In such a manner, each of the two seat support rods (440) can be pivoted relative to the respective backrest support rod (400) from the position as shown in FIG. 2 to the position as shown in FIG. 7, thereby allowing the chair to be folded.

It should be clear to those skilled in the art that further embodiments may be made without departing from the scope and spirit of the present invention.

What is claimed is:

1. A security device for a foldable chair, said foldable chair comprising a substantially U-shaped seat support frame (44) including two seat support rods (440) each having a first end portion and a second end portion, a substantially U-shaped front support frame (46) including two front legs (460) each having an upper end portion, a lower end portion, and a mediate portion pivotally mounted to said first end portion of one of said two corresponding seat support rods (440), a substantially U-shaped rear support frame (47) including two rear legs (470) each having a lower end portion, a mediate portion, and an upper end portion pivotally mounted to said second end portion of one of said two corresponding seat support rods (440), and including an extension (472) extending upward in an inclined manner, a substantially inverted U-shaped backrest support frame (40) including two backrest support rods (400) each having an upper end portion, a mediate portion, and a lower end portion pivotally mounted to said extension (472) of said upper end portion of one of said two corresponding rear legs (470), two armrests (45) each having a first end portion pivotally mounted to said upper end portion of one of said two corresponding front legs (460), and a second end portion pivotally mounted to said mediate portion of one of said two corresponding backrest support rods (400), and two linking rods (42) each including a first end portion pivotally mounted to said mediate portion of one of said two corresponding front legs (460), and a second end portion pivotally mounted to one of said two corresponding backrest support rods (400) located between said mediate portion and said lower end portion, and said security device comprising:

two elongated locking strips (10) each adapted to be slidably mounted between one of said two corresponding backrest support rods (400) and one of said two corresponding seat support rods (440), and each including an upper end portion containing therein a substantially L-shaped passage having a longitudinal slide slot (12) and a transverse stop recess (121) connecting with each other, a mediate portion containing an elongated limit slot (14) therein, and a lower end portion containing a locking opening (15) therein;

two slide pins (22) each slidably extending through said slide slot (12) of one of said two corresponding locking strips (10), and each extending through said second end portion of one of said two linking rods (42), and through said lower end portion of one of said two corresponding backrest support rods (400);

two limit pins (21) each extending through said limit slot (14) of one of said two corresponding locking strips (10), and each extending through said lower end portion of one of said two corresponding backrest support rods (400), and through said extension (472) of said upper end portion of one of said two corresponding rear legs (470); and two locking pins (20) each having one end portion secured in said second end portion of one of said two seat support rods (440), and each detachably received in said locking opening (15) of one of said two corresponding locking strips (10).

2. The security device in accordance with claim 1, wherein each of said two locking strips (10) further includes an extension piece (11) transversely extending from said upper end portion thereof.

3. The security device in accordance with claim 1, further comprising two washers (221) each mounted between one of said two corresponding locking strips (10) and one of said two corresponding slide pins (22).

4. The security device in accordance with claim 1, wherein each of said two linking rods (42) contains a hole (422) defined in the second end portion thereof for pivotally receiving said slide pin (22) therein, and each of said two backrest support rods (400) contains a bore (402) defined in the lower end portion thereof for pivotally receiving said slide pin (22) therein.

5. The security device in accordance with claim 1, wherein each of said two backrest support rods (400) contains a bore (404) defined in the lower end portion thereof for pivotally receiving said limit pin (21) therein, and each of said two rear legs (470) contains a hole (474) defined in the extension (472) of the upper end portion thereof for pivotally receiving said limit pin (21) therein.

6. The security device in accordance with claim 1, wherein each of said two seat support rods (440) contains a bore (442) defined in the second end portion thereof for securely receiving said locking pin (20) therein.

* * * * *